US006139107A

United States Patent [19]

Lee

[11] Patent Number: 6,139,107

[45] Date of Patent: Oct. 31, 2000

[54] ARMREST ADJUSTING MECHANISM

[76] Inventor: Ching-Yang Lee, No. 12, Fu Kuei Hsin Tsuen, Alley 6, Heng Shan Tsuen, Heng Shan Hsiang, Hsin Chu Hsien, Taiwan

[21] Appl. No.: 09/531,155

[22] Filed: Mar. 17, 2000

[51] Int. Cl.[7] ..... A47C 7/54

[52] U.S. Cl. ..... 297/411.36; 297/411.35

[58] Field of Search ..... 297/411.35, 411.36, 297/353, 410, 411.38

[56] References Cited

U.S. PATENT DOCUMENTS

| | | | |
|---|---|---|---|
| 5,382,079 | 1/1995 | Wilson et al. | 297/411.36 |
| 5,664,842 | 9/1997 | Tseng | 297/411.36 |
| 5,853,223 | 12/1998 | Ritt et al. | 297/411.36 |
| 5,931,537 | 8/1999 | Gollin et al. | 297/411.36 |
| 6,053,579 | 4/2000 | Nelson et al. | 297/411.36 |
| 6,062,647 | 5/2000 | Mei | 297/411.36 |

*Primary Examiner*—Peter R. Brown

*Attorney, Agent, or Firm*—Dougherty & Troxell

[57] ABSTRACT

An adjusting mechanism for easily and simultaneously adjusting the height and the angular orientation of an armrest is provided. The adjusting mechanism includes a supporting sleeve connected at a lower end to a chair and an outer casing connected at an upper end to an armrest and put around the supporting sleeve. A joint pipe fixed in an upper part of the supporting sleeve includes a first half having multiple rows of locating holes and a second half having multiple horizontally spaced stop grooves. A bent control arm is disposed in the outer casing with an upper end projected from the outer casing to serve as a hand control and a lower end extended into the supporting sleeve. Upward pushing the hand control brings a locating means provided at the lower end of the control arm to disengage from the locating hole and a stop arm provided opposite to the locating means to elastically press against one stop groove, allowing the outer casing to freely move upward or downward and rotate relative to the supporting sleeve and thereby achieve adjustment of the armrest associated therewith.

5 Claims, 5 Drawing Sheets

ARMREST ADJUSTING MECHANISM

BACKGROUND OF THE INVENTION

The present invention relates to an armrest adjusting mechanism, and more particularly to an armrest adjusting mechanism that enables easy adjustment of the height and the angular orientation of the armrest at the same time.

For a user to more comfortably sit on a chair, particularly on an office chair, armrests of the chair are designed to be height and angle adjustable. Conventionally, adjustments of height and of angular orientation of an armrest are separately achieved through two different adjusting mechanisms. It would be appreciated if an adjusting mechanism could be developed for easily adjusting the height and the angular orientation of an armrest at the same time.

SUMMARY OF THE INVENTION

It is therefore a primary object of the present invention to provide an armrest adjusting mechanism that enables easy adjustment of the height and the angular orientation of an armrest at the same time through only one operation.

Another object of the present invention is to provide an armrest adjusting mechanism that would not cause sudden descending of the armrest during adjustment thereof.

To achieve the above and other objects, the armrest adjusting mechanism of the present invention mainly includes a supporting sleeve connected at a lower end to a chair and an outer casing connected at an upper end to an armrest and put around the supporting sleeve. A joint pipe is fixed in an upper part of the supporting sleeve and includes a first half having multiple rows of locating holes and a second half having multiple horizontally spaced stop grooves. An elbow-shaped control arm is disposed in the outer casing with an upper end projected from an upper hole of the outer casing to serve as a hand control and a lower end extended into the joint pipe in the supporting sleeve. A locating means is provided at the lower end of the control arm to normally engage into one locating hole on the first half of the joint pipe.

Upward pushing the hand control brings the locating means to disengage from the locating hole, and causes a stop arm provided at the lower end of the control arm opposite to the locating means to elastically press against one stop groove on the second half of the joint pipe, so that the outer casing is allowed to freely move upward or downward and rotate relative to the supporting sleeve and thereby achieve adjustment of the armrest associated therewith.

The stop arm is plastically molded along with the control arm to outward and downward project from the lower end of the control arm. The configuration of the stop arm allows it to elastically engage with and press against the stop groove to prevent the outer casing from sudden descending during the adjustment.

BRIEF DESCRIPTION OF THE DRAWINGS

The structure and the technical means adopted by the present invention to achieve the above and other objects can be best understood by referring to the following detailed description of the preferred embodiments and the accompanying drawings, wherein.

DETAILED DESCRIPTION OF THE PREFERRED EMBODIMENTS

Figure 1:
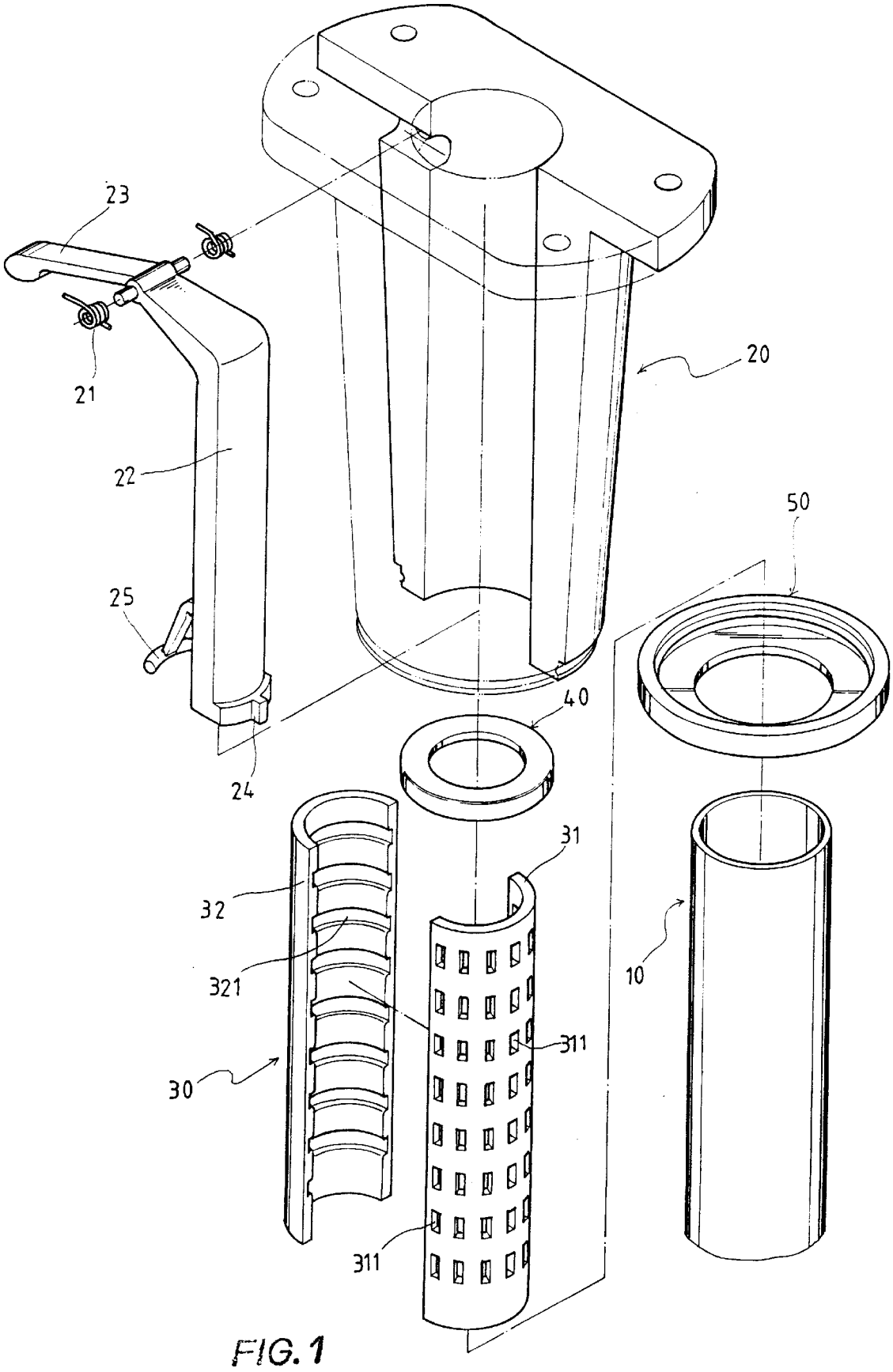
FIG. 1 is an exploded perspective of an armrest adjusting mechanism according to the present invention.
Figure 2:
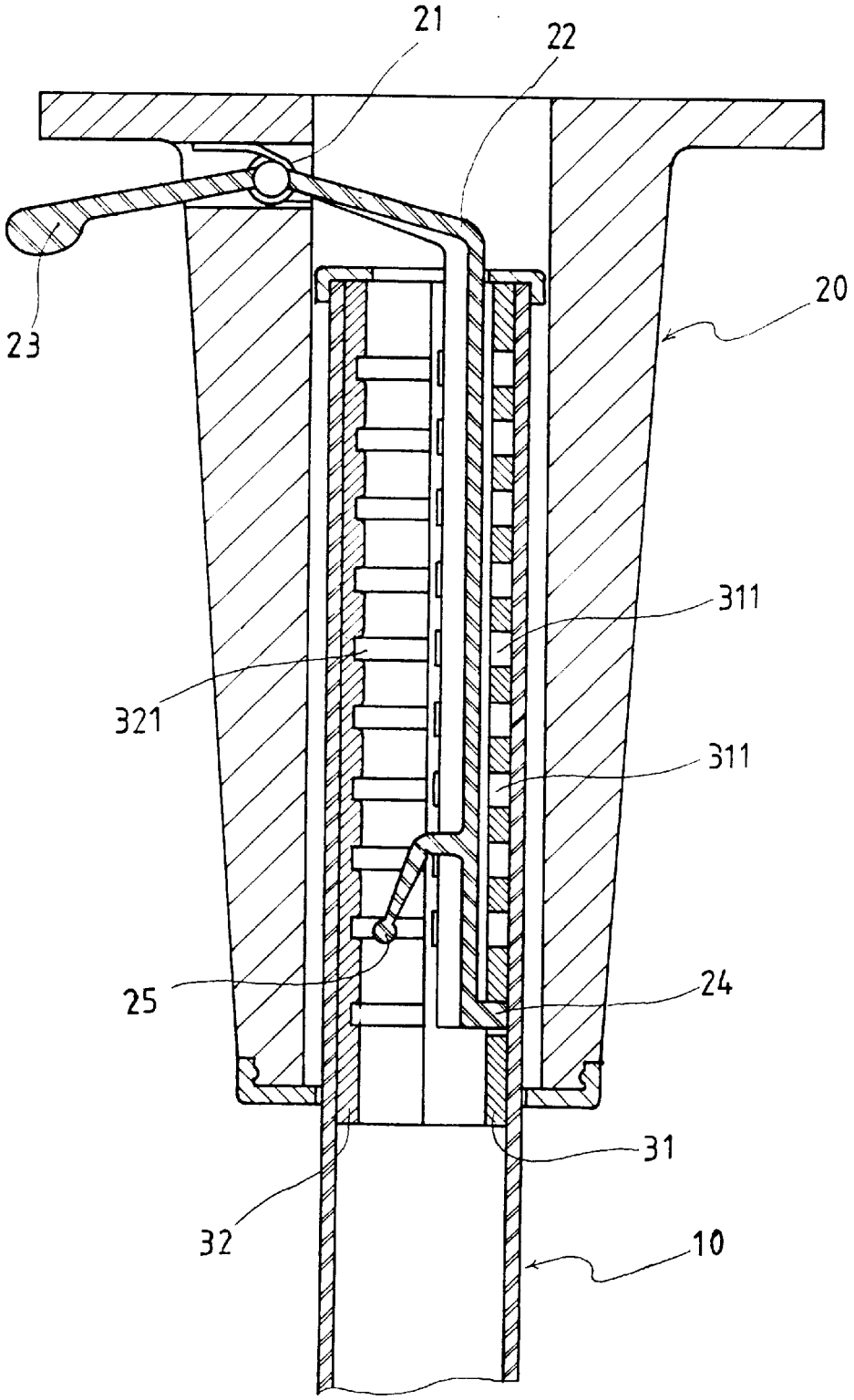
FIG. 2 is an assembled sectional view of the armrest adjusting mechanism of FIG. 1.

Please refer to FIGS. 1 and 2 that are exploded perspective and assembled sectional views, respectively, of an armrest adjusting mechanism according to an embodiment of the present invention. As shown, the mechanism mainly includes a round supporting sleeve 10, a lower end of which is mounted onto or connected to a chair or the like (not shown), and an outer casing 20, an upper end of which is connected to an armrest (not shown) of the chair.

A round joint pipe 30 having a proper length and consisting of two vertically extended curved halves 31, 32 is fitted in an upper part of the round supporting sleeve 10. A first curved half 31 of the joint pipe 30 is provided with a plurality of rows of spaced locating through holes 311, and a second curved half 32 of the joint pipe 30 is provided at an inner surface with a plurality of horizontally spaced stop grooves 321 of proper depth.

An elbow-shaped control arm 22 consisting of a horizontal part having an upward bend and a substantially straight vertical part is positioned in the outer casing 20. A lower end of the vertical part of the control arm 22 downward extends into a space between the two halves of the round joint pipe 30. The horizontal part of the control arm 22 is supported in an opening near a top of the outer casing 20 with a free end of the horizontal part extended from the opening to provide a hand control 23 and the upward bend elastically and pivotally connected to the outer casing 20 in the opening by means of two springs 21. The hand control 23 is preferably located closely below the armrest connected to the upper end of the outer casing 20, so that a user may easily access the hand control 23 to implement an adjustment of the armrest through the armrest adjusting mechanism of the present invention.

The straight vertical part of the control arm 22 is provided at the lower end with a locating means 24 that radially projects from one side of the vertical part facing the first half 31 of the round joint pipe 30 and has a profile suitable for easily engaging into each individual locating hole 311. The straight vertical part of the control arm 22 is also provided at the lower end at another side opposite to the locating means 24 with a stop arm 25 that extends outward and downward from the lower end of the control arm 22 to face toward the second curved half 32 of the joint pipe 30. The stop arm 25 and the control arm 22 may be integrally and plastically molded during manufacture of the control arm 22. With the outward and downward extended configuration and the integrally plastic molding, the stop arm 25 is given sufficient toughness. As can be seen from FIG. 2, a distance by which the tough stop arm 25 outward extends is so determined that when the locating means 24 is disengaged from the locating holes 311, a free end of the stop arm 25 would extend into and elastically press against one corresponding stop groove 321. It is preferable that the free end of the stop arm 25 has a proper width and a curvature the same as that of the stop grooves 321, so that a contact area between the stop arm 25 and the stop groove 321 can be increased to permit higher supporting resistance of the stop arm 25 to the stop grooves 321. The distance by which the stop arm 25 outward extends should also permit the stop arm 25 to move in and along any stop groove 321 without causing the radially projected locating means 24 to contact with the first half 31 of the joint pipe 30.

Retaining rings 40 and 50 may be respectively put around an upper end of the supporting sleeve 10 and a lower end of the outer casing 20 to strengthen an overall structure of the armrest adjusting mechanism in an assembled state while decorating the assembled armrest adjusting mechanism.

Figure 3:
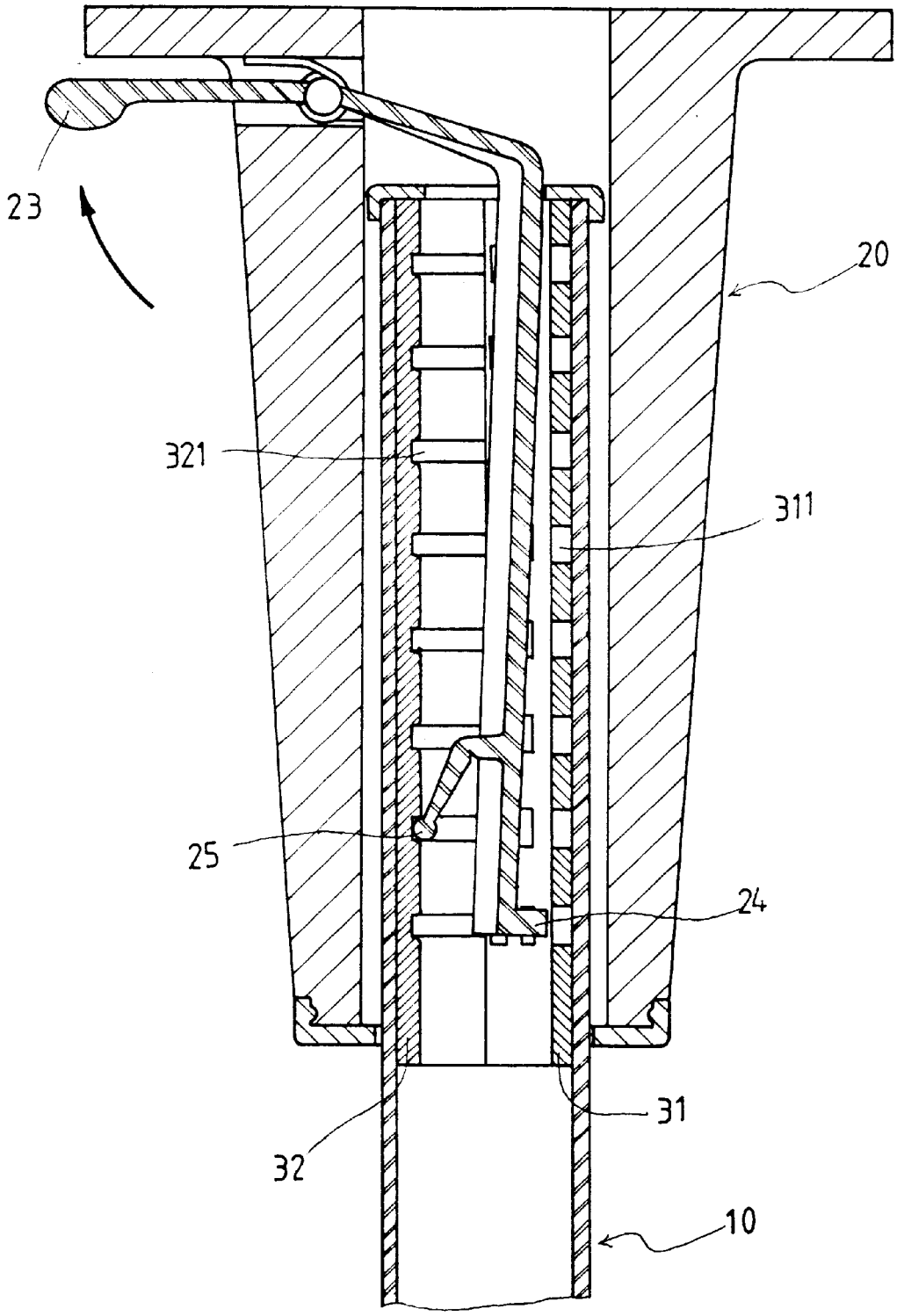
FIG. 3 is an assembled vertical sectional view showing a hand control of the armrest adjusting mechanism of FIG. 1 is upward pushed to enable adjustment of an associated armrest.

With the horizontal part of the control arm 22 elastically and pivotally supported at the bend in the opening below the top of the outer casing, the hand control 23 extended from the outer casing may be upward pushed as indicated in FIG. 3 to pivotally shift the lower end of the vertical part of the control arm 22 away from the first half 31 of the joint pipe 30 and bring the locating means 24 to disengage from the locating hole 311. Or, the hand control 23 may be released as indicated in FIG. 2 to pivotally shift the lower end of the vertical part of the control arm 22 toward the first half 31 of the joint pipe 30 and bring the locating means 24 to engage into one of the locating hole 311.

Figure 4:
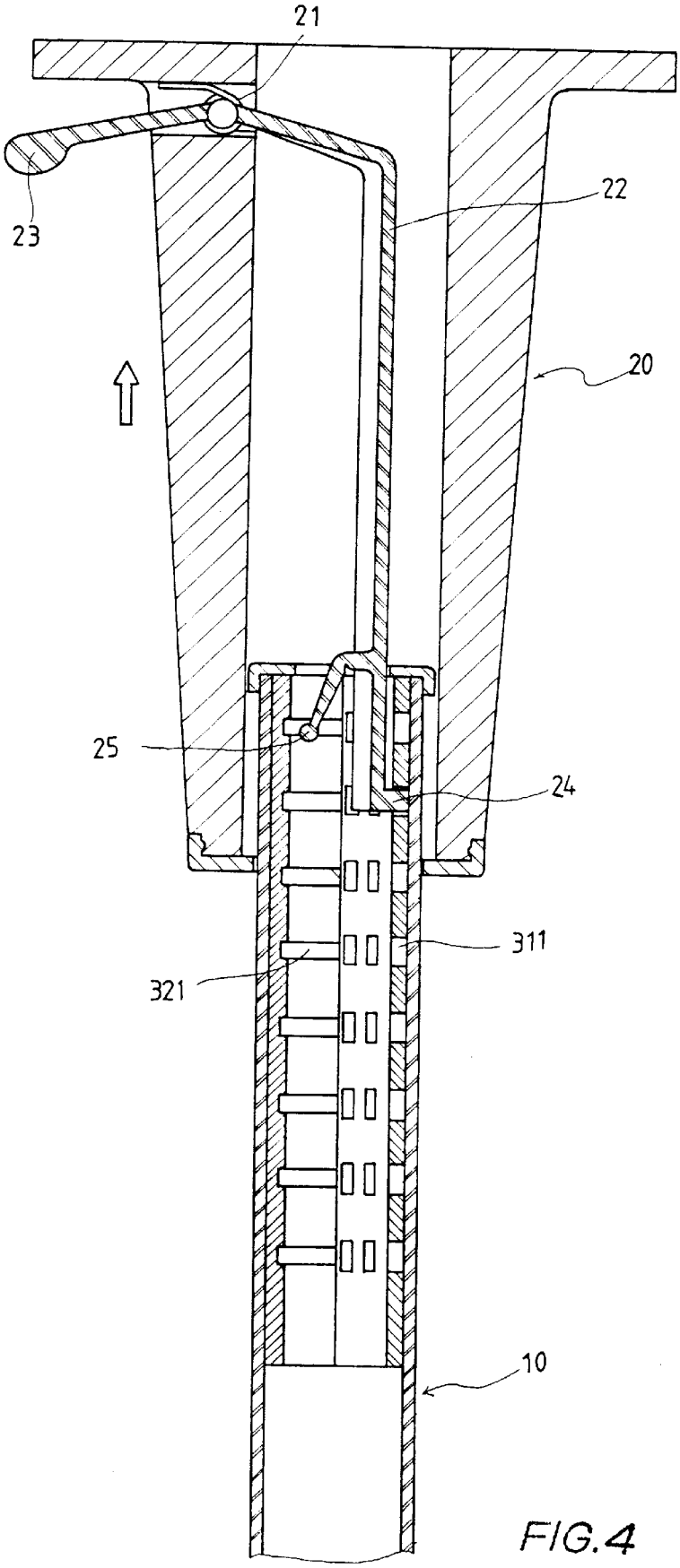
FIG. 4 is an assembled vertical sectional view showing the hand control of the armrest adjusting mechanism of FIG. 1 is released from the upward pushed position when an adjustment of the associated armrest is completed.
Figure 6:
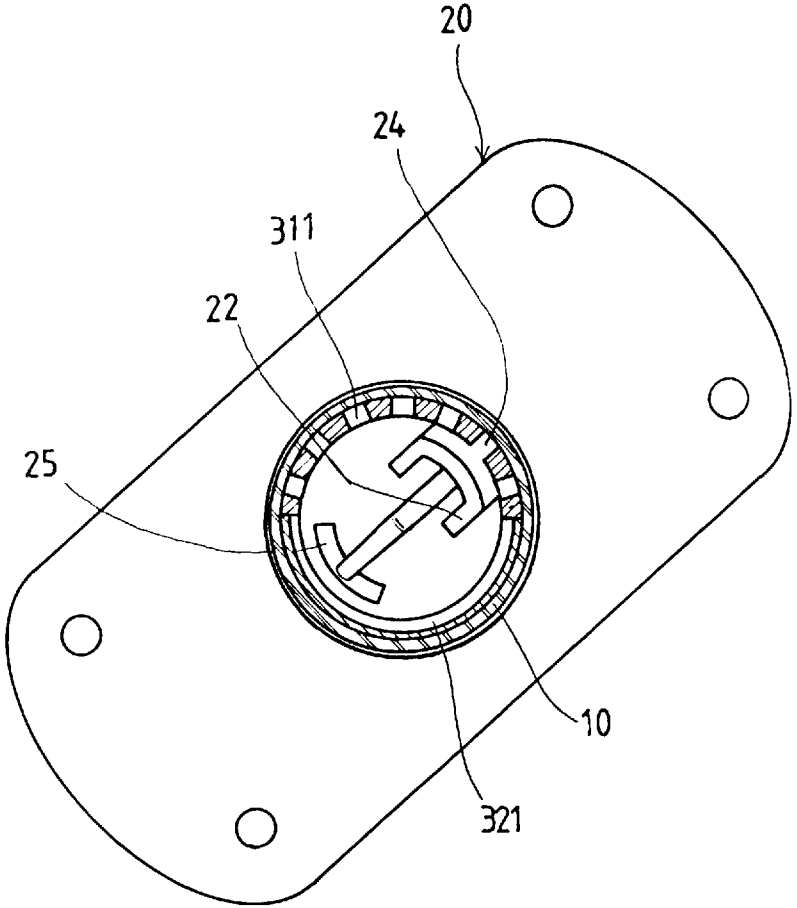
FIG. 6 is a cross sectional view of the armrest adjusting mechanism of FIG. 1 after adjustment of the associated armrest is made through the mechanism.
Figure 5:
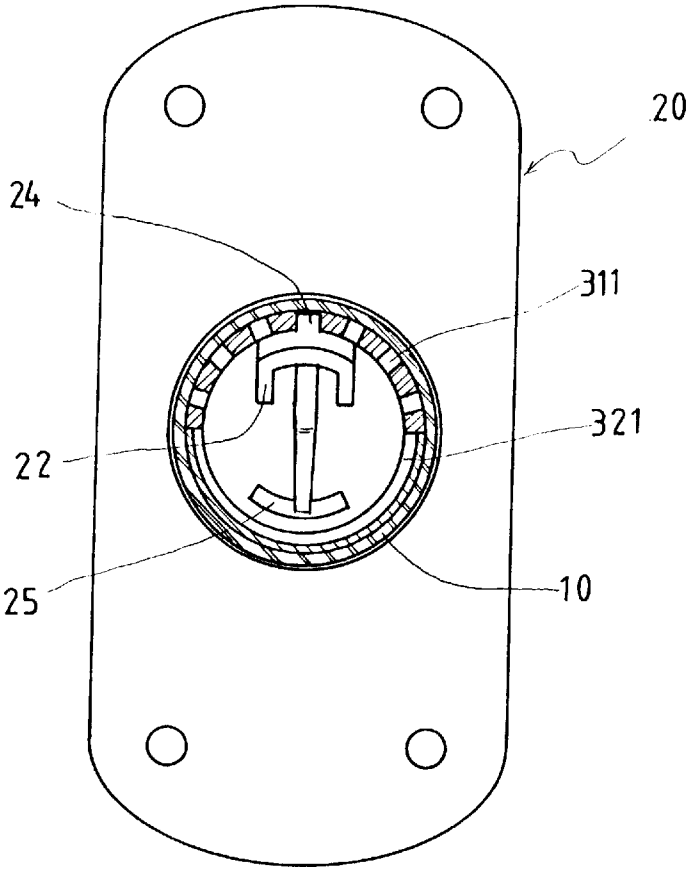
FIG. 5 is a cross sectional view of the armrest adjusting mechanism of FIG. 1 before adjustment of an associated armrest is made through the mechanism.

Please now refer to FIGS. 2 and 5 at the same time. When the locating means 24 of the control arm 22 is engaged into one locating hole 311 of the joint pipe 30, the whole outer casing 20, and accordingly the armrest (not shown) connected to the top of the outer casing 20, are held in place at a certain height and at a certain angle relative to the supporting sleeve 10. When a user intends to adjust the armrest to another desired height and angle relative to the chair (not shown) to which the supporting sleeve 10 is fixedly connected, he or she needs only to push the hand control 23 upward, as indicated by the arrow in FIG. 3, causing the vertical part of the control arm 22 to pivotally shift away from the first half 31 of the joint pipe 30 and thereby disengage the locating means 24 from the locating hole 311. At this point, by holding the hand control 23 at the upward pushed position, it is possible to move the outer casing 20 from, for example, a lower position to a higher position relative to the supporting sleeve 10, as shown in FIG. 4. Meanwhile, it is also possible to rotate the outer casing 20 relative to the supporting sleeve 10, as shown in FIG. 6, until a desired angular orientation of the armrest is obtained. As a matter of fact, a moving path of the outer casing 20 during the adjustment of the armrest in its height and angle relative to the chair is a three-dimensional oblique and curved line. When the hand control 23 is released, the springs 21 elastically return the vertical part of the control arm 22 to its position toward the first half 31 of the joint pipe 30, allowing the locating means 24 to engage into another locating hole 311 easily selected through the above height and angle adjustment of the outer casing 20 relative to the supporting sleeve 10, as illustrated in FIG. 4, and thereby lock the armrest (not shown) to the new height and angular orientation.

When the locating means 24 is caused to disengage from the location hole 311, the stop arm 25 at the opposite side of the locating means 24 is moved to engage into and press against one of the stop grooves 321 on the second half 32 of the joint pipe 30. Due to the supporting resistance of the stop arm 25 to the stop groove 321, the outer casing 20 is prevented from complete separating from the supporting sleeve 10 and sudden descending during the height and angle adjustments of the armrest. To facilitate easy engagement of the locating means 24 with the locating holes 311, bevel surfaces may be provided at outer peripheries of the locating holes 311 as auxiliary means to guide the locating means 24 into the locating holes 311. And, it is possible to reduce the space between two adjacent stop grooves 321, so that the stop grooves 321 are densely arranged to provide a stageless bearing effect.

The present invention has been described in an illustrative manner, and it is to be understood that many modifications and variations of the present invention are possible without departing from the spirit and the scope of the invention.

What is claimed is:

1. An armrest adjusting mechanism, comprising a supporting sleeve, a lower end of which is mounted onto or connected to a chair or the like, and an outer casing, an upper end of which is connected to an armrest of the chair;

said supporting sleeve being fixedly provided in an upper part with a round joint pipe having a proper length and consisting of two vertically extended curved halves, a first curved half of said joint pipe being provided with a plurality of rows of spaced locating through holes, and a second curved half of said joint pipe being provided at an inner surface with a plurality of horizontally spaced stop grooves of proper depth; and said outer casing being put around said supporting sleeve and having an elbow-shaped control arm consisting of a horizontal part with an upward bend and a substantially straight vertical part positioned therein, a lower end of said vertical part of said control arm downwardly extending into a space between said two halves of said joint pipe, and said horizontal part of said control arm being supported in an opening near a top of said outer casing with a free end of said horizontal part extended from said opening to provide a hand control and said upward bend elastically and pivotally connected to said outer casing in said opening by means of two springs; said vertical part of said control arm being provided at the lower end with a locating means that radially projects from one side of said vertical part facing said first half of said joint pipe and has a profile suitable for easily engaging into each individual locating hole, said vertical part of said control arm being also provided at the lower end at another side opposite to said locating means with a stop arm that extends outward and downward from the lower end of said control arm to face toward said second curved half of said joint pipe; a distance by which said stop arm outward extends being so determined that when said locating means is disengaged from said locating holes, a free end of said stop arm would most preferably extend into and elastically press against one of said stop grooves;

whereby when said hand control extended from said outer casing is upwardly pushed, said lower end of said control arm is pivotally shifted away from said first half of said joint pipe, causing said locating means to disengage from said locating hole and thereby allowing said outer casing to be moved upward or downward or rotated relative to said supporting sleeve to a desired position, and when said hand control is released, said lower end of said control arm is pivotally shifted toward said first half of said joint pipe to cause said locating means to engage into said locating hole at a selected position and thereby easily complete adjustment of said armrest to a desired height and angle relative to said chair at one time.

2. An armrest adjusting mechanism as claimed in claim 1, wherein said hand control is preferably located at a position closely below said armrest, so that a user may easily access and upwardly push said hand control.

3. An armrest adjusting mechanism as claimed in claim 1, wherein said stop arm and said control arm are integrally and plastically molded during manufacture of said control arm so that said outward and downward extended stop arm is provided with sufficient toughness, and wherein said stop arm has a predetermined width and a curvature the same as that of said stop grooves, such that a contact area between said stop arm and each of said stop grooves is maximized.

4. An armrest adjusting mechanism as claimed in claim 1, wherein said locating holes are provided at outer peripheries with guiding bevel surfaces for said locating means to engage into said locating holes more easily.

5. An armrest adjusting mechanism as claimed in claim 1, wherein said stop grooves are densely arranged on said second half of said joint pipe at reduced spacing distance between any two of said stop grooves adjacent to each other.

* * * * *